US010900266B2

(12) United States Patent
Jeffries

(10) Patent No.: US 10,900,266 B2
(45) Date of Patent: Jan. 26, 2021

(54) HINGE FOR CABINET

(71) Applicant: Austin Hardware & Supply, Inc., Lee's Summit, MO (US)

(72) Inventor: Mark Steven Jeffries, Buford, GA (US)

(73) Assignee: AUSTIN HARDWARE AND SUPPLY, INC., Lee's Summit, MO (US)

( * ) Notice: Subject to any disclaimer, the term of this patent is extended or adjusted under 35 U.S.C. 154(b) by 0 days.

(21) Appl. No.: 15/699,034

(22) Filed: Sep. 8, 2017

(65) Prior Publication Data

US 2018/0073289 A1 Mar. 15, 2018

Related U.S. Application Data

(60) Provisional application No. 62/393,379, filed on Sep. 12, 2016.

(51) Int. Cl.
*E05D 7/081* (2006.01)
*E05D 5/02* (2006.01)
(Continued)

(52) U.S. Cl.
CPC ..... *E05D 7/081* (2013.01); *E05D 5/0215* (2013.01); *E05D 7/123* (2013.01); *E05D 7/125* (2013.01);
(Continued)

(58) Field of Classification Search
CPC ..... E05D 7/081; E05D 7/123; E05D 7/125; E05D 5/0215; E05D 5/065; Y10T 16/558;
(Continued)

(56) References Cited

U.S. PATENT DOCUMENTS 122,088 A * 12/1871 Wells ..... E05D 3/02 16/387
2,655,686 A * 10/1953 Summersgill ..... E05D 5/04 16/387

(Continued)

FOREIGN PATENT DOCUMENTS

CH 323276 A * 7/1957

OTHER PUBLICATIONS

Office Action dated Aug. 8, 2019 for Canadian Patent Application No. 2,978,926; (2 pages).

(Continued)

*Primary Examiner* — Victor D Batson
*Assistant Examiner* — Matthew J Sullivan
(74) *Attorney, Agent, or Firm* — Polsinelli PC

(57) ABSTRACT

An integrated hinge for a cabinet is described. The integrated hinge includes a central portion having a first outer edge and a second outer edge. The integrated hinge includes a first lateral portion having a first inner edge. The integrated hinge includes a second lateral portion having a second inner edge. A hinge pin rotatably connects the central portion, the first lateral portion, and the second lateral portion. The first outer edge and the first inner edge are angled toward the hinge pin at a positive angle relative to the hinge pin, and the second outer edge angled and the second inner edge are angled toward the hinge pin at a negative angle relative to the hinge pin.

18 Claims, 8 Drawing Sheets

(51) Int. Cl.
*E05D 7/12* (2006.01)
*F25D 23/02* (2006.01)

(52) U.S. Cl.
CPC ..... *E05Y 2900/204* (2013.01); *F25D 23/028* (2013.01)

(58) Field of Classification Search
CPC ..... Y10T 16/559; Y10T 16/5595; Y10T 16/55975; Y10T 16/55963; Y10S 16/29
See application file for complete search history.

(56) References Cited

U.S. PATENT DOCUMENTS 3,439,377 A * 4/1969 Bucholz ..... E05D 5/065 16/389
4,891,862 A * 1/1990 Holan ..... E05D 11/1014 16/278
5,722,121 A * 3/1998 Lau ..... E05D 5/128 16/381
5,735,085 A * 4/1998 Denooy ..... E04D 13/08 137/579
7,406,748 B2 * 8/2008 Baer ..... E05D 3/022 16/354
7,536,747 B2 * 5/2009 Christeson ..... E05D 5/02 16/247
8,375,520 B2 * 2/2013 Roy ..... E05D 11/1014 16/223
2016/0326787 A1 * 11/2016 Criddle ..... E05D 5/0215

OTHER PUBLICATIONS

Notice of Allowance dated Jul. 22, 2020 for Canadian Patent Application No. 2,978,926; (1 page).

* cited by examiner

HINGE FOR CABINET

CROSS REFERENCE TO RELATED APPLICATION

This application claims the benefit of U.S. Provisional Patent Application 62/393,379 filed Sep. 12, 2016, which is hereby incorporated by reference.

FIELD OF INVENTION

The present invention relates to a hinge for a cabinet, including an integrated hinge that mounts a frame to the cabinet.

SUMMARY

An integrated hinge is described. The integrated hinge may be used to hingedly connect a frame to a cabinet. The frame provides a door to the cabinet. The frame may include sliding panels to cover the opening of the cabinet. A combination hinged door with sliding panels may be used to cover the opening of the cabinet—commonly called a restocking closure. The integrated hinge is well suited for use in cabinets and frames on emergency vehicles, such as ambulance, fire trucks, etc. The cabinets and frame may be used for storage on such vehicles. The frames with sliding panels and hinged connections to the cabinet may be used to close the cabinets and prevent the contents of the cabinet from falling out of the cabinet.

The cabinets may further include the frame with the restocking closure, which includes the hinged door with built-in sliding closures. This allows for the cabinet to be completely opened for restocking the cabinet, and also allows the cabinet to be accessed by sliding the closures, such as Plexiglas panels, to an open position for immediately retrieve items from the cabinet.

The integrated hinge hingedly connects the frame to the cabinet. The integrated hinge includes a central portion, a first lateral portion, and a second lateral portion rotatably engaged to a hinge pin. The first and second lateral portions engage to the cabinet. The central portion engages to the frame. The central portion includes a first outer edge and a second outer edge. The first lateral portion includes a first inner edge. The second lateral portion includes a second inner edge. The first outer edge and the first inner edge are angled toward the hinge pin at a positive angle relative to the hinge pin, and the second outer edge and the second inner edge are angled toward the hinge pin at a negative angle relative to the hinge pin.

The integrated hinge is commonly installed on a top of the frame and allows a "lift-up" arrangement. In other aspects, the integrated hinge may be installed on a side of the frame for a "swing out" configuration. In other aspects, the integrated hinge may be installed on a bottom of the frame for a "drop down" configuration.

In a closed position, the first inner edge of the first lateral portion inter-locks with the first outer edge of the central portion. Likewise, in the closed position, the second inner edge of the second lateral portion inter-locks with the second outer edge of the central portion. The first and second outer edges of the central portion taper inward—when moving toward the hinge pin. The outer edge of the central portion is generally the widest portion of the central portion. From the outer edge, the first and second outer edges of the central portion angle or taper inward to a connection portion that engages with a hinge. The portions of the first and second lateral portions that engage with the hinge are generally the widest portions of the first and second lateral portions. The first and second inner edges are angled to correspond with the first and second outer edges of the central portion that are tapering inward toward the hinge. The positive and negative angles of the first and second outer edges and the first and second inner edges provide interlocking structures that provide strength and rigidity to the hinge in the event of a vehicle crash or impact.

In the closed position, the angled outer edges of the central portion are approximately adjacent to the angled inner edges of the lateral portions. This assists in providing a hinge capable of withstanding impact from a vehicle crash. In the closed position, gaps separate the angled outer edges of the central portion and the angled inner edges of the lateral portions. During a crash, these gaps close to reduce and/or absorb the stress on the hinge and to reduce the likelihood of the hinge failing. The integrated hinge provides a robust design that is stronger than conventional hinge designs. The integrated hinge may withstand accidents and collisions that could occur while in use on an emergency vehicle.

In one aspect, the first outer edge of the central portion and the first inner edge of the first lateral portion angle toward the hinge pin at a positive angle relative to the hinge pin, while the second outer edge of the central portion and the second inner edge of the second lateral portion angle toward the hinge pin at a negative angle relative to the hinge pin. This provides for the central portion to lock into place between the lateral portions when there is an accident.

In one aspect, the integrated hinge includes a central portion, a first lateral portion, and a second lateral portion. The first lateral portion includes a first connecting portion generally perpendicular to a first attachment portion, and the second lateral portion includes a first connecting portion generally perpendicular to a second attachment portion. The first connecting portion and the second connecting portion rotatably engage to a hinge pin. The first and second attachment portions typically mount to the cabinet, and the central portion typically mounts or engages to the frame or door. During an impact, collision, or other instances of increased stress, the generally perpendicular angle between the first connecting portion and the second connecting portion relative to the first attachment portion and the second attachment portion will deflect or widen by several degrees or more, for example to approximately 95 degrees or 100 degrees. During an impact, the central member will move forward with the frame or door, while the attachment portions are fixed to the cabinet. The central portion, the first lateral portion, and the second lateral portion include angled sides, and under normal use, there is a gap between the angled sides on the center portion and the two lateral portions. When the central member move forwards during the impact, the angled sides will eventually close the gap and lock-up with each other. The movement prior to lock-up reduces resulting impact forces, and then the lock-up prevents additional movement forward. These two features allow for greater impact absorption and greater retention strength of the hinge.

In another aspect, the integrated hinge includes outer fixed leafs attached to a top wall of a cabinet and a center moving leaf attached to a frame. The outer fixed leafs both have an inner side surface that will engage to outer side surfaces of the center moving leaf when the center moving leaf moves forward. The fixed leafs and the moving leaf are rotatably engaged to hinge pin. If a very high force hits the frame directly behind the integrated hinge, the outer fixed leafs yield and unbend slightly which allows the center leaf and frame to move forward. As the frame moves forward, the movement reduces a gap between the side surfaces of the outer leafs and the center leaf. When the forward movement results in the being gap reduced to zero, the integrated hinge locks up preventing additional movement of the frame.

DETAILED DESCRIPTION OF INVENTION

Figure 1:
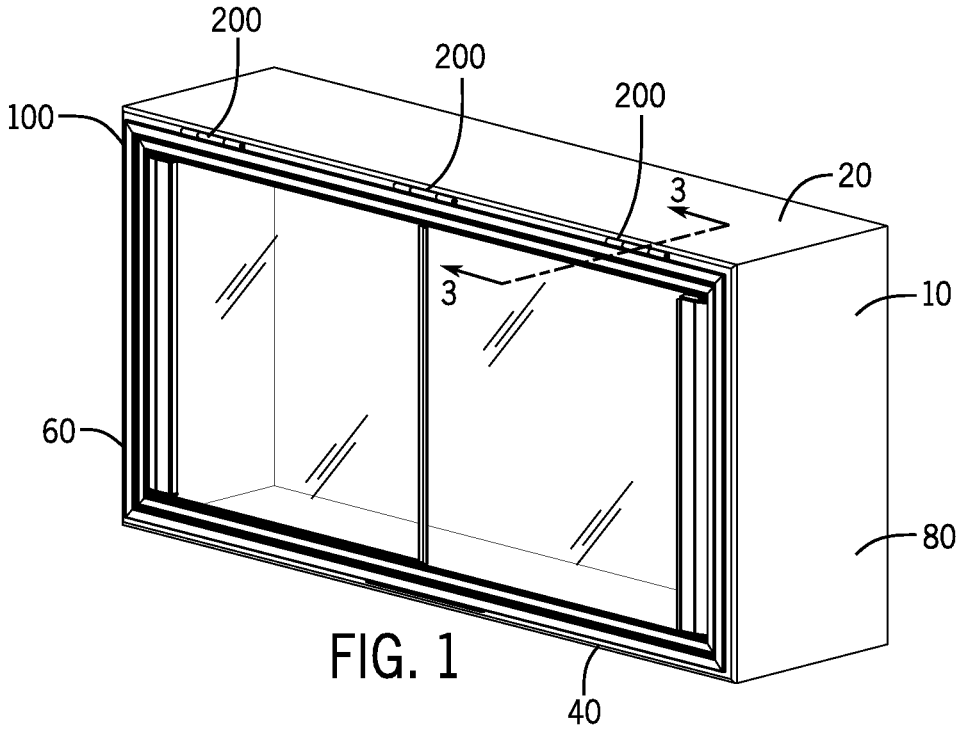
FIG. 1 is a perspective view of the frame engaged to the cabinet via the integrated hinge.
Figure 2:
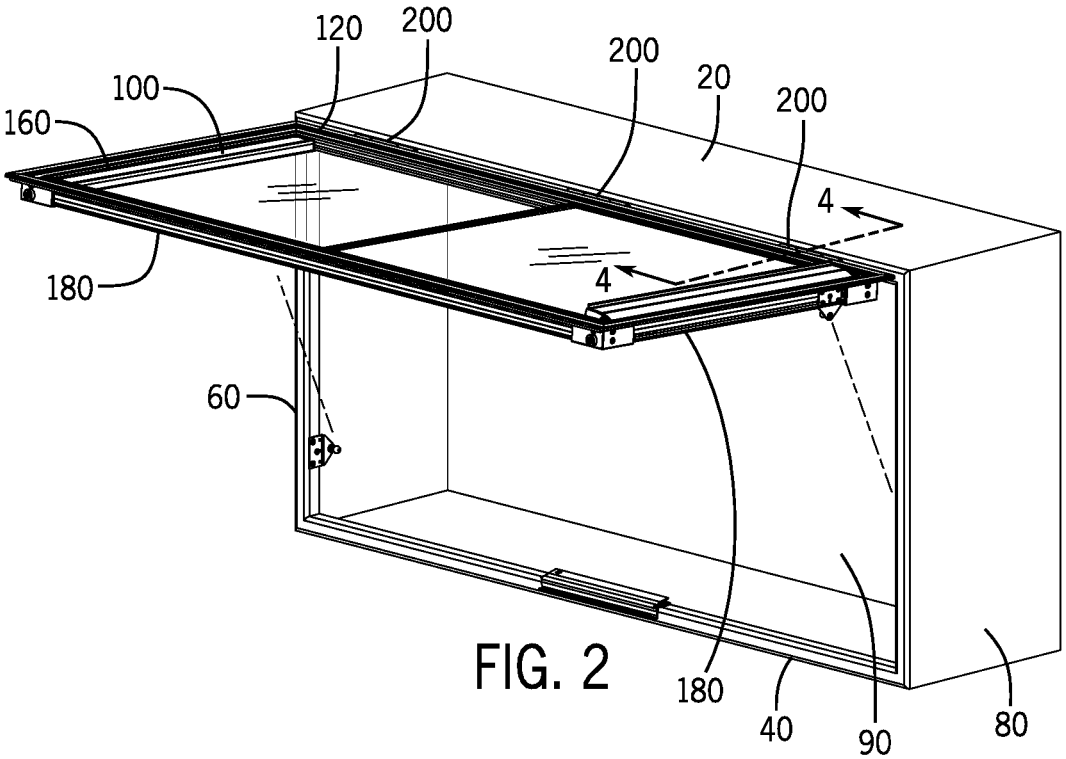
FIG. 2 is a perspective view of the frame engaged to the cabinet via the integrated hinge with the frame in an open position.

With reference to FIGS. 1 and 2, a cabinet 10 and a frame 100 are shown. The frame 100 hingedly engages to a front of the cabinet 10 via an integrated hinge 200. One or more integrated hinges 200 may hingedly connect to frame 100 to the cabinet 10.

The cabinet includes an upper wall 20 opposite of a lower wall 40 and a left side wall 60 opposite of a right side wall 80. The walls 20, 40, 60, and 80 may be fastened together with or without a rear wall 90. The frame 100 includes an upper frame section 120 opposite of a lower frame section 140 and a left frame section 160 opposite of a right frame section 180. The cabinet 10 may be formed to have a generally rectangular or square shape. One or more gas-springs may be incorporated between the cabinet 10 and frame 100 to control the opening and closing of the frame 100.

The integrated hinge 200 includes a central portion 220, a first lateral portion 240, and a second lateral portion 260. The first and second lateral portions 240, 260 engage to the cabinet 10. The central portion 220 engages to the frame 100. The central portion 220 provides for a center moving leaf for the hinge 200.

Figure 3:
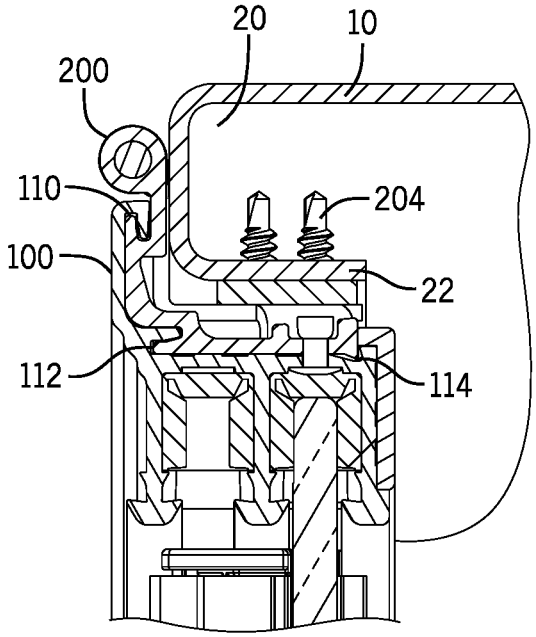
FIG. 3 is a sectional view of the frame closed on the cabinet.
Figure 4:
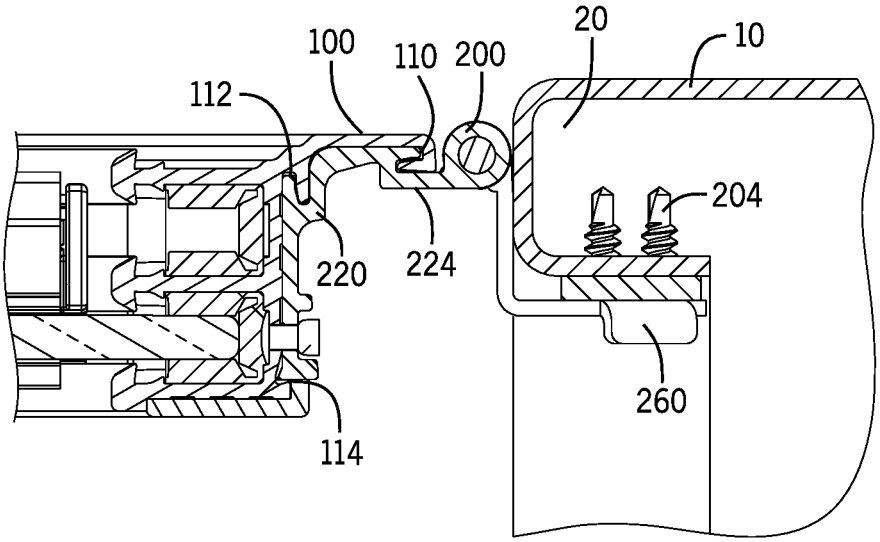
FIG. 4 is a sectional view of the frame in an open position with respect to the cabinet.
Figure 5:
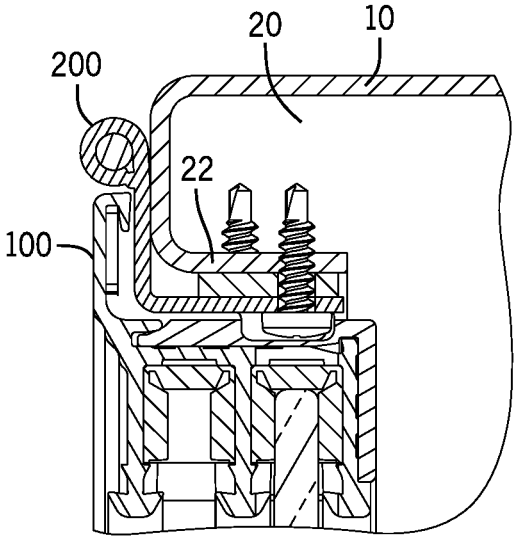
FIG. 5 is a sectional view of the frame closed on the cabinet.
Figure 6:
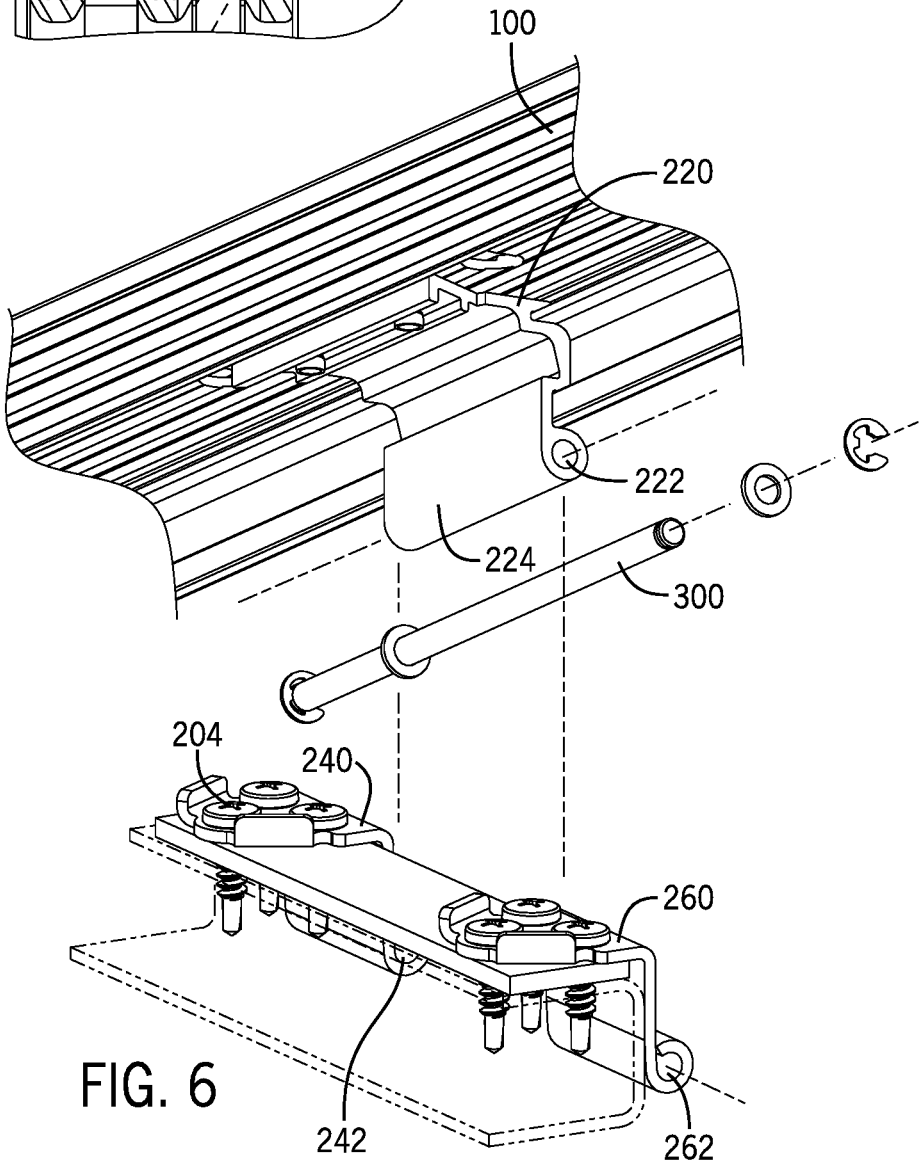
FIG. 6 is an exploded view of the hinge.

The central portion 220 interlocks with the upper section 120 of the frame 100. As shown in FIGS. 3 and 4, the central portion 220 engages with grooves 110, 112, and 114 on the upper section 120. The grooves 110, 112, and 114 may be formed as part of the extrusion used in making the upper frame section 110. The central portion 220 includes a central connecting portion 224 that engages with the grooves 110, 112, and 114. The central connecting portion 224 includes several protrusions or extensions that fit with or match the grooves 110, 112, and 114.

The first and second lateral portions 240 and 260 include a semi-triangular shape with a base side proximate the hinge pin 300. The first and second lateral portions 240 and 260 include one or more openings 202. Fasteners 204 pass through the openings 202 of the first and second lateral portions 240 and 260 and engage the first and second lateral portions 240 and 260 to the cabinet 10. The first and second lateral portions 240 and 260 provide outer fixed leafs for the hinge 200.

The central portion 220 includes central hinge passage 222. The first lateral portion 240 includes a first lateral hinge passage 242. The second lateral portion 260 includes a second lateral hinge passage 262. A hinge pin 300 passes through the central hinge passage 222, the first lateral hinge passage 242, and the second lateral hinge passage 262. The hinge pin 300 rotatably connects the central portion 220 with the first and second lateral portions 240, 260. The central portion 220 includes a flared or semi-triangular shape that narrows in width at the central hinge passage 220.

Figure 7:
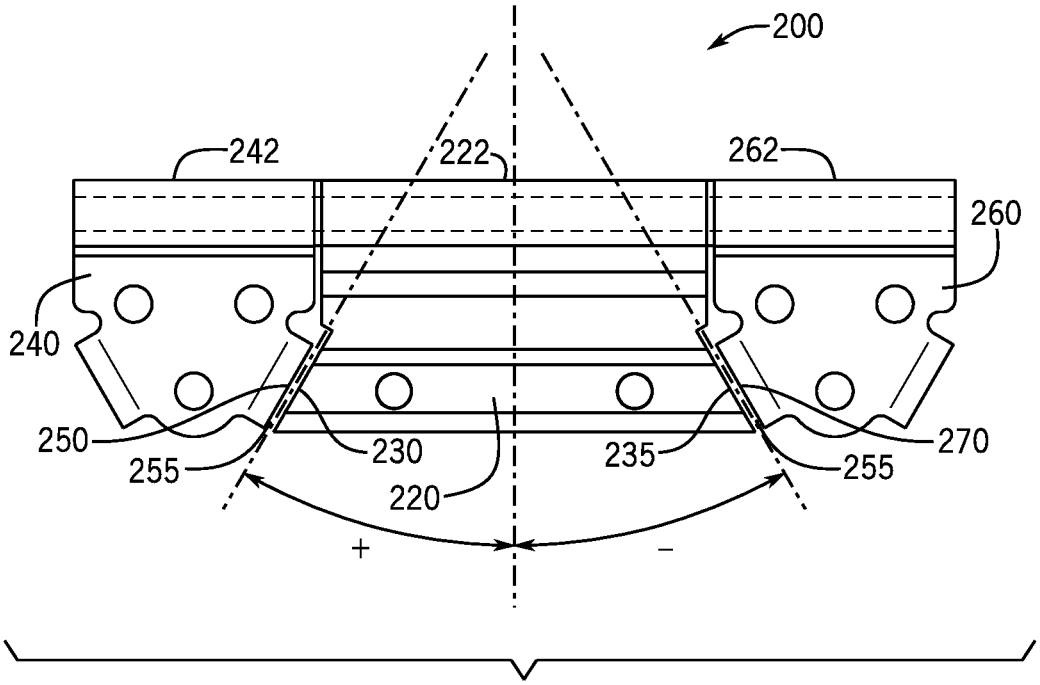
FIG. 7 is a top down view of the hinge.
Figure 8:
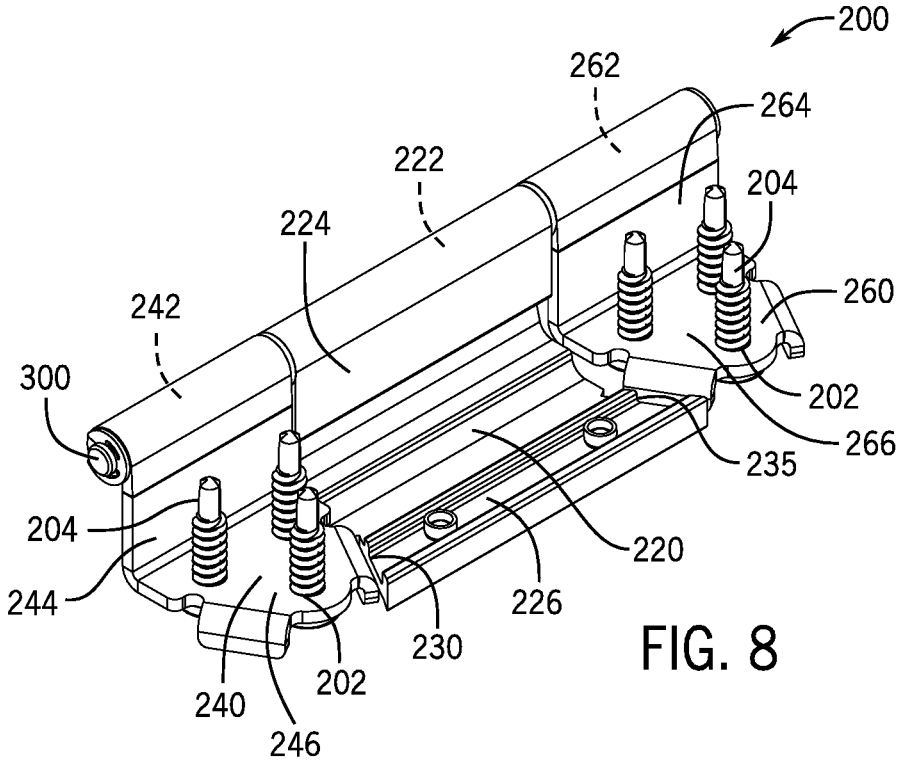
FIG. 8 is a perspective view of the hinge in a closed position.
Figure 9:
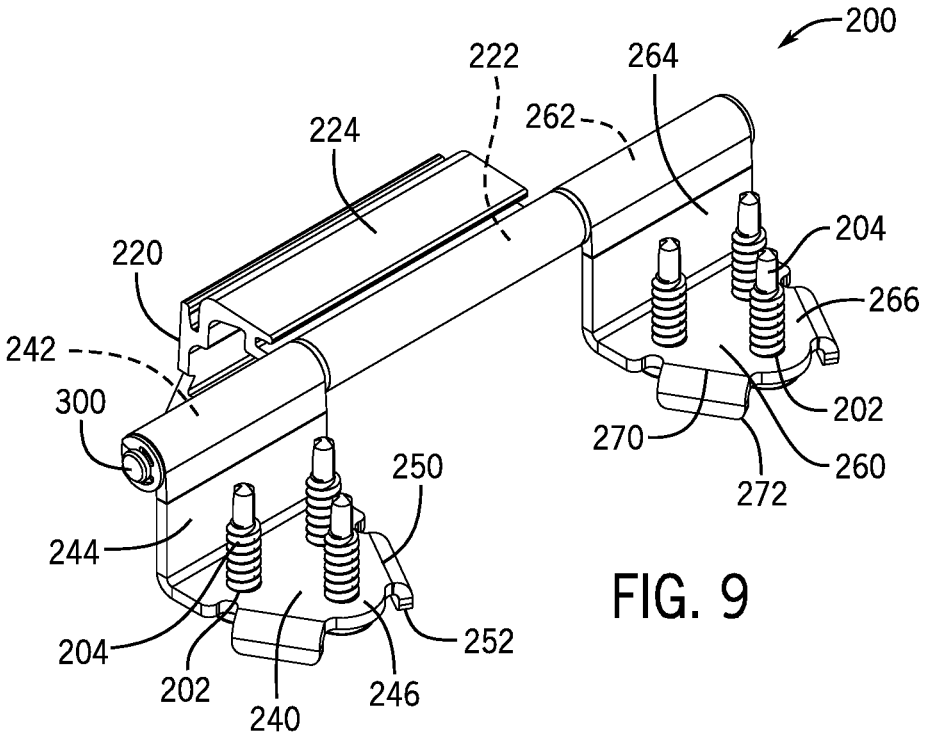
FIG. 9 is a perspective view of the hinge in an open position.

With respect to FIGS. 7-9, the central portion 220 is positioned between the first lateral portion 240 and the second lateral portion 260. In FIGS. 7-9, the first lateral portion 240 is to a left of the central portion 220 and the second lateral portion 260 is to a right of the central portion 220. The first lateral portion 240 includes a first connecting portion 244 generally perpendicular to a first attachment portion 246. The first connection portion 244 includes the first lateral hinge passage 242 opposite to the first attachment portion 246. The second lateral portion 260 includes a second connecting portion 264 generally perpendicular to a second attachment portion 266. The second connection portion 264 includes the second lateral hinge passage 262 opposite to the second attachment portion 266. In one aspect, the fasteners 204 pass through openings 202 in the first and second attachment portions 246 and 266 to engage the first and second lateral portions 240 and 260 to a lower surface 22 of the upper wall 20 of the cabinet 10. Upper surfaces of the attachment portions 246 and 266 may be flush against the lower surface 22 of the upper wall 20. In other aspects, shims, spacers, etc. may be used between the upper surfaces of the attachment portions 246 and 266 and the lower surface 22 of the upper wall 20.

The central portion 220 includes the central connecting portion 224 generally perpendicular to a central engagement portion 226. The central connecting portion 224 includes the central hinge passage 222 opposite to the central engagement portion 226.

A first inner edge 250 of the first lateral portion 240 is angled. The first inner edge 250 includes a generally straight portion. A first outer edge 230 of the central portion 220 is angled in the same direction moving toward the hinge pin 300 such that the inner edge 250 is flush with the first outer edge 230. The first outer edge 230 also includes a generally straight portion. A second inner edge 270 of the second lateral portion 260 is also angled. The second inner edge 270 also includes a generally straight portion. Similarly, a second outer edge 235 of the central portion 220 is angled in the same direction moving toward the hinge pin 300 such that an inner edge 270 of the second lateral portion 260 is flush with the second outer edge 235. The second outer edge 270 also includes a generally straight portion. For example, in the aspect shown in FIG. 7, the first outer edge 230 of the central portion 220 is angled at approximately positive 45 degrees moving toward the hinge pin 300, and the first inner edge 250 is angled at approximately positive 45 degrees moving toward the hinge pin 300. The second outer edge 235 of the central portion 220 is angled at approximately negative 45 degrees moving toward the hinge pin 300, and the second inner edge 270 is also angled at approximately negative 45 degrees. In the aspects shown, the first outer edge 230 of the central portion 220 is angled at approximately the same direction and in the same amount as the first inner edge 250, and the second outer edge 235 of the central portion 220 is angled at approximately the same direction and in the same amount as the second inner edge 270. The angle of orientation of the first outer edge 230 and the first inner edge 250 is generally in the same amount, but in the opposite direction of the angle of orientation of the second outer edge 235 and the second inner edge 270. In other aspects, the respective positive and negative angles between the central portion 220 and the first lateral portion and the second lateral portion 240 and 260 may vary. In FIG. 7, the angle X is approximately +45 degrees on the first lateral portion 240 side and approximately −45 degrees on the second lateral portion 260 side. In other aspects, the angle X may range from approximately ±20 degrees to approximately ±70 degrees. In this aspect, the angle X between the central portion 220 and the first lateral portion 240 and the second lateral portion 260 has the same absolute value. In other aspects, the angle X may be different between the two sides of the central portion 220.

The central portion 220 includes the outer edges 230 and 235 that angle inward toward the hinge pin 300. The outer edges 230 and 235 angle inward with generally opposite angles. The first and second lateral portion 240 and 260 include the inner edges 250 and 270 that angle inward toward the hinge pin 300. The outer edge 230 angle inwards toward the hinge pin 300 in an amount that is approximately opposite of an amount the outer edge 235 angles inward toward the hinge pin 300. The outer edges 230 and 235 are slightly spaced from the inner edges 250 and 270. There is generally a gap 255 or space between the outer edges 230 and 235 the inner edges 250 and 270.

With respect to FIGS. 8 and 9, the integrated hinge 200 is shown in open and closed positions. The inner edge 250 of the first lateral portion 240 is also angled downward or includes a downward extending member 252. The inner edge 270 of the second lateral portion 260 is also angled downward or includes a downward extending member 272. These downward portions 252 and 272 will abut or force against the first and second outer edges 230 and 235 of the central member 220 when a force is applied to the integrated hinge 200 via the cabinet 10 or the door 100. These structures of the integrated hinge 200 reinforce and/or strengthen the integrated hinge 200 to withstand severe and extreme forces.

Figure 10:
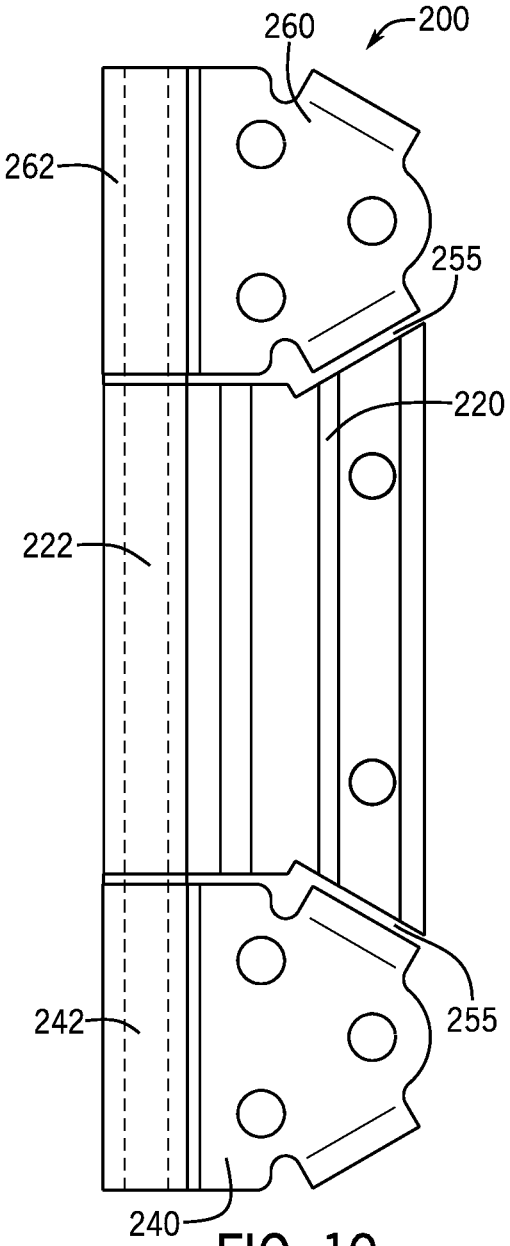
FIG. 10 is a top down view of the hinge pre-impact.
Figure 11:
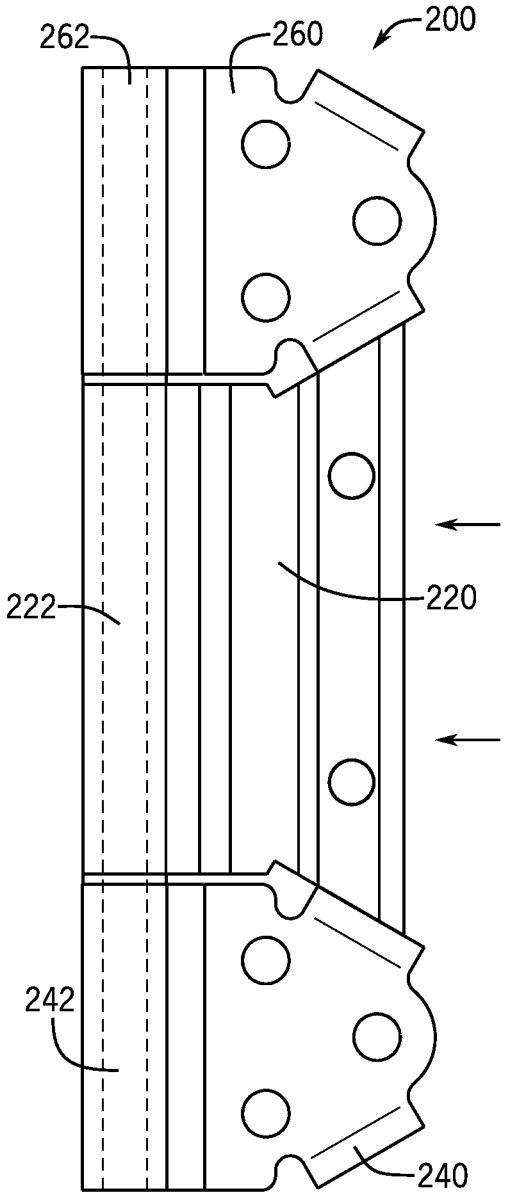
FIG. 11 is top down view of the hinge post-impact.
Figure 12:
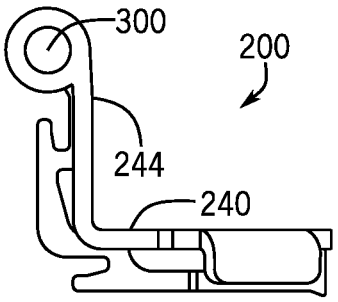
FIG. 12 is a side view of the hinge pre-impact.
Figure 13:
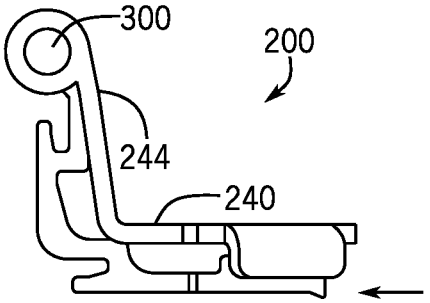
FIG. 13 is a side view of the hinge post-impact.

FIGS. 10-13 are views of the integrated hinge 200 before and after an impact, such as an impact that may occur during a vehicle collision. FIGS. 10 and 12 are views of the integrated hinge 200 pre-impact. FIGS. 11 and 13 are views of the integrated hinge 200 post-impact. Under normal use of the integrated hinge 200, as shown in FIG. 10, there is a gap 255 between the outer edges 230 and 235 of the central portion 220 and the inner edges 250 and 270 of the first and second lateral portion 240 and 260. Under normal use of the integrated hinge 200, as shown in FIG. 12, the first connecting portion 244 is generally perpendicular to the first attachment portion 246, and the second connecting portion 264 is generally perpendicular to the second attachment portion 266. During an impact, collision, or other instances of increased stress, such as shown in FIGS. 11 and 13, the generally perpendicular angle between the first connecting portion 244 and the second connecting portion 264 relative to the first attachment portion 246 and the second attachment portion 266 will deflect, deflect, and/or widen by several degrees or more, for example to approximately 95 degrees or 100 degrees, and the connecting portions 244, 264 of the lateral members 240, 260 are allowed to move forward—thus yielding to the impact. This forward movement of the connecting portions 244, 264 is movement relative to the cabinet 10. During an impact, the central portion 220 will move forward with the frame 100, while the attachment portions 246, 266 of the lateral members 240, 260 are fixed to the cabinet 10. When the central portion 220 move forwards during the impact, the outer edges 230 and 235 of the central portion 220 will eventually lock-up with the inner edges 250 and 270.

This forward movement of the connecting portions 244, 264 is movement relative to the cabinet face, but the central hinge passage 222 moves with the lateral hinge passages 242 and 262 as the hinge passages 222, 242, and 262 are engaged with the hinge pin 300. This displacement causes the gap 255 between the outer edges 230 and 235 of the central portion 220 and the inner edges 250 and 270 of the lateral portions 240, 260 to decrease until they contact each other. At this point, the deformation of the angles on the connecting portions 244, 264 cannot continue and the central portion 220 (and thus the frame 100) are "locked up" and cannot move further outward. The movement prior to lock-up reduces resulting impact forces and then the lock-up prevents additional movement forward. These features allow for greater impact absorption and greater retention strength of the hinge 200.

As described above, under normal use, there is normally the gap 255 between the outer edges 230 and 235 of the central portion 220 and the inner edges 250 and 270 of the first and second lateral portion 240 and 260. The gap 255 may be approximately 1/16 inch to approximately 1/4 inch in width. In the aspect shown, the gap 255 is approximately 1/8 inch in width. Under normal use, the outer edge 230 is generally aligned parallel to the inner edge 250 and the outer edge 235 is generally aligned parallel to the inner edge 270. During and/or after a collision, the gap 255 may be reduced or no longer exist as the outer edges 230 and 235 of the central portion 220 may now contact the inner edges 250 and 270.

Figure 14:
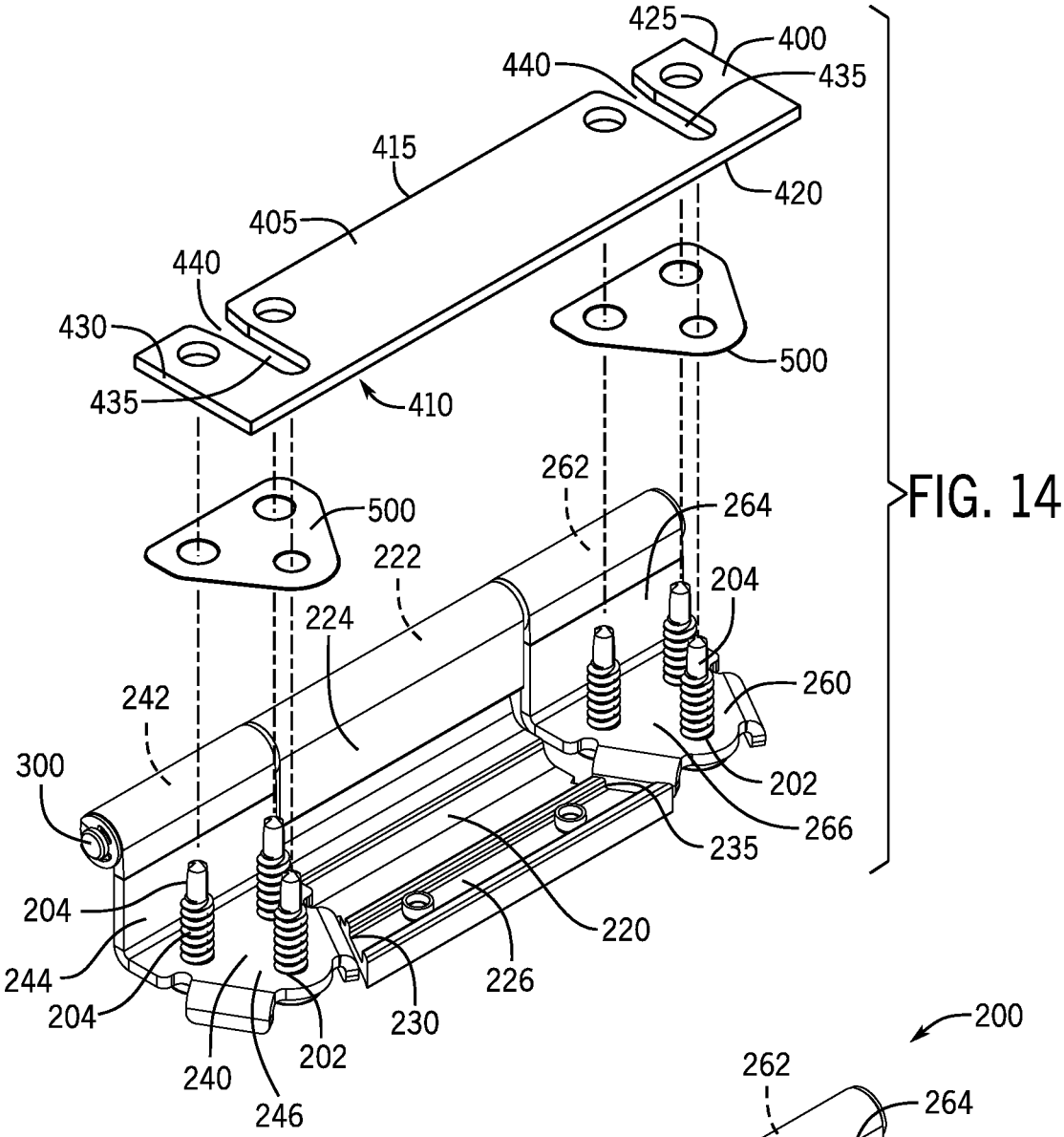
FIG. 14 is an exploded view of the hinge incorporating the shim.
Figure 15:
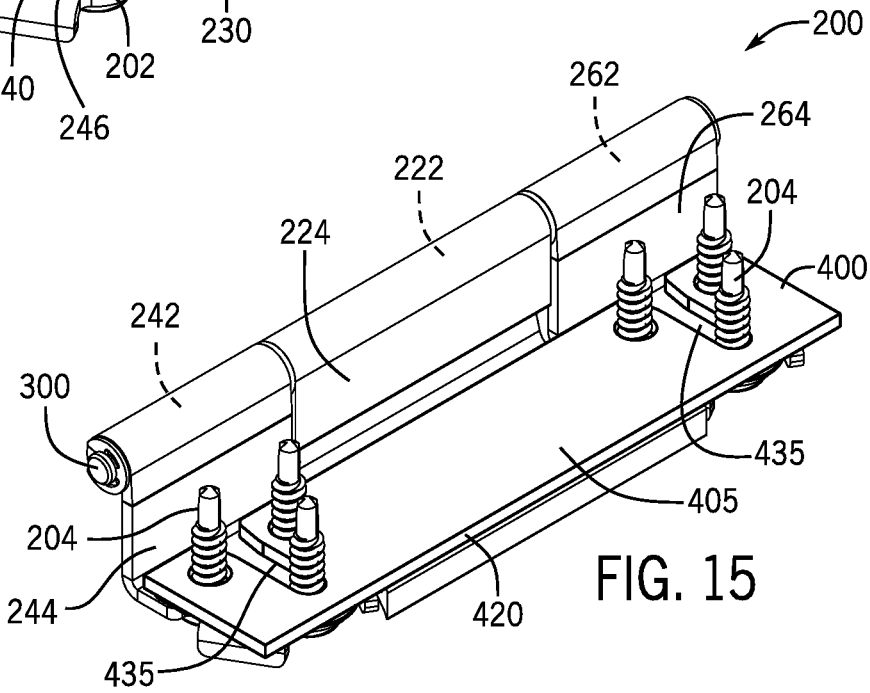
FIG. 15 is a perspective view of the hinge incorporating the shim.
Figure 16:
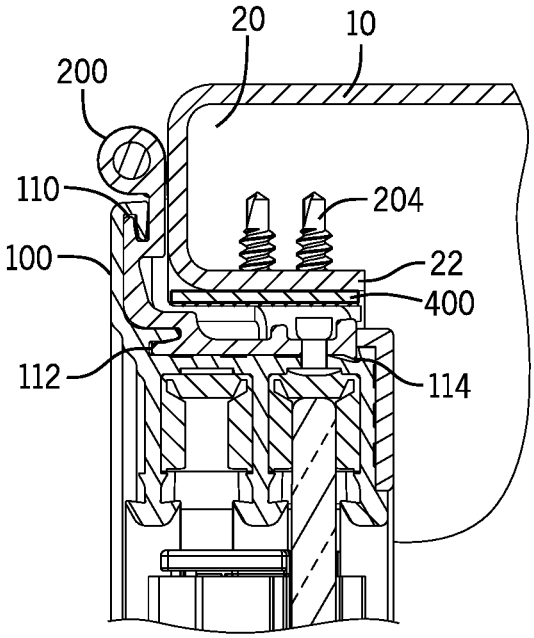
FIG. 16 is a sectional view of the hinge incorporating the shim.

In other aspects, with reference to FIGS. 14-16, the integrated hinge 200 may be installed along with an optional shim 400. The shim 400 mounts between the frame 100 and the cabinet 10 to compensate for cabinet height variations. The shim 400 helps to fine-tune the installation of the frame 100 to the cabinet 10. The shim 400 acts as a positioner to adjust the vertical position or height of the integrated hinge 200 and the frame 100. Two or more shims 400 may be used together to adjust the vertical position or height of the integrated hinge 200 and the frame 100. The shims 400 may be provided in different thickness such that two or more shims 400 may be used together that have different thickness. Further, different shims 400 may be used with a particular frame 100 and cabinet 10 to determine which of the shims 400 provides the best fit for the frame 100 to the cabinet 10.

The shim 400 may include a generally rectangular shape. The shim 400 has an upper surface 405 opposite of a lower surface 410. The shim 400 has a front edge 415 opposite of a rear edge 420. The shim 400 has a first lateral edge 425 opposite of a second lateral edge 430. The shim 400 includes one or more slots 435 that are formed from an opening 440 in the front edge 415. The slots 435 provide an opening to receive the fasteners 204. A plane of the slots 435 is generally perpendicular to the fasteners 204. The slots 435 may extend a majority of the depth of the shim 400. In the aspect shown in FIGS. 14-16, the slots 435 extend approximately ¾ of the depth of the shim 400.

In the aspect shown in FIGS. 14-16, the shim 400 includes two slots 435 positioned to accommodate the fasteners 204. As described above, the integrated hinge 200 includes the first and second lateral portions 240 and 260 that include the openings 202. The fasteners 204 pass through the openings 202 of the first and second lateral portions 240 and 260 and engage the first and second lateral portions 240 and 260 to the cabinet 10. The shim 400 acts as a height adjustment to modulate the vertical position the integrated hinge 200 and the frame 100. For example, if the frame 100 needs to be lowered to properly close with respect to the cabinet 10, then one more shims 400 may be added between the frame 100 and the cabinet 10.

The openings 440 of the slots 435 may include rounded corners or a radius at the beginning of the openings 440 in order to aid the installer in aligning the slots 435 with the fasteners 204. If during the installation process the user finds that the frame 100 needs to be lowered, then the user may loosen the fasteners 204 and insert the shim 400 in between the cabinet 10 and the first and second lateral portions 240 and 260 of the integrated hinge 100. The user is not required to fully remove the frame 100 in order to install the shim 400 between the cabinet 10 and the first and second lateral portions 240 and 260 of the integrated hinge 100.

An optional layer or application of a double sided adhesive may further optionally be incorporated into the assembly process. For example, adhesive pads 500 may be applied to an upper surface of the first and second lateral portions 240 and 260. The adhesive pads 500 may ease the installation process by holding the integrated hinge 100 to the cabinet 10. The adhesive pads 500 may ease the installation process by holding the shim 400 in the proper position over the upper surfaces of the first and second lateral portions 240 and 260. The adhesive pads 500 may be shaped to match the outline of the upper surfaces of the first and second lateral portions 240 and 260.

As such, it should be understood that the disclosure is not limited to the particular aspects described herein, but that various changes and modifications may be made without departing from the spirit and scope of this novel concept as defined by the following claims. Further, many other advantages of applicant's disclosure will be apparent to those skilled in the art from the above descriptions and the claims below.

What is claimed:

1. An integrated hinge, comprising:

a central portion having a first outer edge and a second outer edge on lateral sides of the central portion;

a first lateral portion having a first inner edge;

a second lateral portion having a second inner edge, and the second lateral portion separate from the first lateral portion;

the central portion separate from the first lateral portion and the second lateral portion; a hinge pin rotatably connecting the central portion, the first lateral portion, and the second lateral portion, and the central portion between the first lateral portion and the second lateral portion;

wherein the central portion includes a central hinge passage, the first lateral portion includes a first lateral hinge passage, and the second lateral hinge portion includes a second lateral hinge passage, and wherein the hinge pin passes through the central hinge passage, the first lateral hinge passage, and the second lateral hinge passage;

the first outer edge and the first inner edge angled toward the hinge pin at a positive angle relative to the hinge pin, and the second outer edge and the second inner edge angled toward the hinge pin at a negative angle relative to the hinge pin; and the integrated hinge is configured to be move between open and closed positions, wherein in the closed position, the first inner edge of the first lateral portion is adjacent to the first outer edge of the central portion and the second inner edge of the second lateral portion is adjacent to the second outer edge of the central portion, and the first and second lateral portions interlock with the first outer edge and the second outer edge of the central portion to resist separation of the central portion from the first and second lateral portions.

2. The integrated hinge according to claim 1, wherein the central portion includes a central connecting portion generally perpendicular to a central engagement portion, the central connecting portion includes the central hinge passage opposite the central engagement portion, the first lateral portion includes a first connecting portion generally perpendicular to a first attachment portion, the first connecting portion includes the first lateral hinge passage opposite to the first attachment portion, the second lateral portion includes a second connecting portion generally perpendicular to a second attachment portion, and the second connection portion includes the second lateral hinge passage opposite to the second attachment portion.

3. The integrated hinge according to claim 1, wherein the first and second outer edges are spaced from the first and second inner edges.

4. The integrated hinge according to claim 1, wherein the first inner edge of the first lateral portion is angled downward or includes a downward extending member, and the second inner edge of the second lateral portion is angled downward or includes a downward extending member.

5. The integrated hinge according to claim 1, wherein the central portion includes a central connecting portion generally perpendicular to a central engagement portion, the central connecting portion includes the central hinge passage opposite the central engagement portion, the first lateral portion includes a first connecting portion generally perpendicular to a first attachment portion, the first connecting portion includes the first lateral hinge passage opposite to the first attachment portion, the second lateral portion includes a second connecting portion generally perpendicular to a second attachment portion, and the second connection portion includes the second lateral hinge passage opposite to the second attachment portion, wherein the generally perpendicular angles between the first connecting portion and the first attachment portion and the second connecting portion and the second attachment portion deflect or deform during an impact to absorb stress from the impact.

6. The integrated hinge according to claim 1, wherein the central portion is configured to deform toward the lateral portions.

7. The integrated hinge according to claim 1, wherein the first and second outer edges of central portion are configured to deform toward the first and second inner edges.

8. The integrated hinge according to claim 1, wherein there is a gap between the first and second outer edges of the central portion and the first and second inner edges in the closed position of the integrated hinge.

9. The integrated hinge according to claim 8, wherein the first and second outer edges of central portion are configured to deform toward the first and second inner edges to close the gap.

10. An integrated hinge, comprising:

a central portion having a first outer edge and a second outer edge on lateral sides of the central portion;

a first lateral portion having a first inner edge;

a second lateral portion having a second inner edge, and the second lateral portion separate from the first lateral portion;

the central portion separate from the first lateral portion and the second lateral portion;

a hinge pin rotatably connecting the central portion, the first lateral portion, and the second lateral portion, the central portion positioned between the first lateral portion and the second lateral portion;

wherein the central portion includes a central hinge passage, the first lateral portion includes a first lateral hinge passage, and the second lateral hinge portion includes a second lateral hinge passage, and wherein the hinge pin passes between the central hinge passage, the first lateral hinge passage, and the second lateral hinge passage;

the first outer edge angles toward the hinge pin at a positive angle, and the second outer edge angles to toward the hinge at a negative angle in an amount approximately equal to the positive angle;

the integrated hinge is configured to be move between open and closed positions, wherein in the closed position, the first inner edge is spaced from the first outer edge by a first gap, and the second inner edge is spaced from the second outer edge by a second gap; and, wherein, in the closed position, the first inner edge of the first lateral portion and the second inner edge of the second lateral portion interlock with the first and second outer edges of the central portion to resist movement of the central portion away from the first and second lateral portions.

11. A cabinet with a hinging frame, comprising:

a cabinet, a frame;

an integrated hinge to engage the cabinet and the frame, comprising:

a first lateral portion having a first inner edge;

a second lateral portion having a second inner edge, and the second lateral portion separate from the first lateral portion;

a central portion having a first outer edge and a second outer edge on lateral sides of the central portion, and the central portion separate from the first lateral portion and the second lateral portion;

a hinge pin rotatably connecting the central portion, the first lateral portion, and the second lateral portion; and, wherein the central portion includes a central hinge passage, the first lateral portion includes a first lateral hinge passage, and the second lateral hinge portion includes a second lateral hinge passage, and wherein the hinge pin joins the central hinge passage, the first lateral hinge passage, and the second lateral hinge passage the first outer edge and the first inner edge angled toward the hinge pin at a positive angle relative to the hinge pin, and the second outer edge and the second inner edge angled toward the hinge pin at a negative angle relative to the hinge pin;

the integrated hinge configured to be move between open and closed positions, wherein in the closed position, the first inner edge of the first lateral portion is adjacent to the first outer edge of the central portion and the second inner edge of the second lateral portion is adjacent to the second outer edge of the central portion;

wherein fasteners engage the first and second lateral portions to the cabinet;

wherein the central portion engages to the frame; and, wherein, in the closed position, the first and second inner edges interlock with the first outer edge and the second outer edge of the central portion to resist movement of the central portion and frame away from the first and second lateral portion and the cabinet.

12. The cabinet according to claim 11, wherein the central portion engages with grooves of the frame to attach the central portion to the frame.

13. The cabinet according to claim 11, wherein the frame is formed from extruded frame sections, and the central portion engages with an integral groove of one of the extruded frame sections to attach the central portion to the one extruded frame section.

14. The cabinet according to claim 11, wherein the frame is formed from extruded frame sections, and the central portion engages with an integral groove of an upper frame section to attach the central portion to the upper frame section.

15. The cabinet according to claim 11, further comprising a shim between the first and second lateral portions and the cabinet.

16. The cabinet according to claim 11, wherein the shim comprises two slots to accommodate fasteners that are engaging the first and second lateral portions to the cabinet.

17. The cabinet according to claim 11, further comprising a shim between the first and second lateral portions and the cabinet, wherein the shim adjusts the height of the frame relative to the cabinet.

18. The cabinet according to claim 11, further comprising a shim and an adhesive layer between the frame and the first and second lateral portions.

* * * * *